US009564114B2

(12) United States Patent
Nakae

(10) Patent No.: US 9,564,114 B2
(45) Date of Patent: Feb. 7, 2017

(54) ELECTRONIC MUSICAL INSTRUMENT, METHOD OF CONTROLLING SOUND GENERATION, AND COMPUTER READABLE RECORDING MEDIUM

(71) Applicant: CASIO COMPUTER CO., LTD., Shibuya-ku, Tokyo (JP)

(72) Inventor: Tetsuichi Nakae, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 45 days.

(21) Appl. No.: 14/660,615

(22) Filed: Mar. 17, 2015

(65) Prior Publication Data

US 2015/0348525 A1 Dec. 3, 2015

(30) Foreign Application Priority Data

May 29, 2014 (JP) ..... 2014-110810

(51) Int. Cl.

| | |
|---|---|
| ***G10H 1/00*** | (2006.01) |
| ***G10H 1/053*** | (2006.01) |
| ***G10H 1/057*** | (2006.01) |
| ***G10H 1/06*** | (2006.01) |
| ***G10H 3/18*** | (2006.01) |
| ***G10H 5/00*** | (2006.01) |

(52) U.S. Cl.

CPC ..... *G10H 1/0008* (2013.01); *G10H 1/053* (2013.01); *G10H 1/057* (2013.01); *G10H 3/18* (2013.01); *G10H 3/182* (2013.01); *G10H 5/005* (2013.01); *G10H 2220/211* (2013.01); *G10H 2220/361* (2013.01)

(58) Field of Classification Search

CPC ..... G10H 1/053; G10H 1/057; G10H 1/0008; G10H 5/005; G10H 2220/361; G10H 2220/211

USPC ..... 84/735

See application file for complete search history.

(56) References Cited

U.S. PATENT DOCUMENTS

| | | | | | |
|---|---|---|---|---|---|
| 3,609,201 | A * | 9/1971 | Adachi | G10H 1/0558 | 331/78 |
| 4,038,895 | A * | 8/1977 | Clement | G10H 5/002 | 4/558 |
| 4,342,244 | A * | 8/1982 | Perkins | G10H 1/32 | 84/171 |
| 4,385,541 | A * | 5/1983 | Muller | G10H 1/32 | 84/377 |
| 4,757,737 | A * | 7/1988 | Conti | G10H 1/32 | 704/258 |

(Continued)

FOREIGN PATENT DOCUMENTS

| | | |
|---|---|---|
| JP | 2605761 B2 | 4/1997 |
| JP | 2712406 B2 | 2/1998 |
| JP | 3389618 B2 | 3/2003 |

*Primary Examiner* — David Warren
*Assistant Examiner* — Christina Schreiber
(74) *Attorney, Agent, or Firm* — Holtz, Holtz & Volek PC

(57) ABSTRACT

An electronic musical instrument is provided with a voice sensor for detecting a voice uttered by a user, when the user blows into the musical instrument with a voice, a breath sensor for detecting at least one of a blow pressure and a blow volume in a body of the musical instrument, when the user blows into the musical instrument with a voice, and a musical tone controlling unit for controlling generation of a musical tone based on at least one of outputs of the voice sensor and the breath sensor.

10 Claims, 6 Drawing Sheets

(56) References Cited

U.S. PATENT DOCUMENTS 4,915,008 A * 4/1990 Sakashita ..... G10H 1/00 84/658
4,919,032 A * 4/1990 Sakashita ..... G10H 1/182 84/653
5,010,801 A * 4/1991 Sakashita ..... G10H 1/053 84/735
5,069,106 A * 12/1991 Sakashita ..... G10H 1/055 84/626
5,149,904 A * 9/1992 Kamiya ..... G10H 1/02 84/395
5,245,130 A * 9/1993 Wheaton ..... G10H 1/0066 84/377
5,300,727 A * 4/1994 Osuga ..... G10H 1/0008 84/477 R
5,403,966 A * 4/1995 Kawashima ..... G10H 1/0553 84/612
6,011,206 A * 1/2000 Straley ..... G10D 7/06 84/297 S
6,570,077 B1 * 5/2003 Goss ..... G09B 15/06 84/383 R
7,049,503 B2 * 5/2006 Onozawa ..... G10H 1/055 84/723
7,309,827 B2 * 12/2007 Sakurada ..... G10H 5/005 704/207
7,321,094 B2 * 1/2008 Sakurada ..... G10H 1/0016 84/477 R
7,390,959 B2 * 6/2008 Masuda ..... G10H 1/053 84/662
7,470,852 B2 * 12/2008 Masuda ..... G10H 1/053 84/615
7,605,324 B2 * 10/2009 Masuda ..... G10H 1/0008 84/723
7,772,482 B2 * 8/2010 Shibata ..... G10H 1/348 84/723
7,786,372 B2 * 8/2010 Sawada ..... G10D 9/04 84/380 R
8,581,087 B2 * 11/2013 Hashimoto ..... G10H 1/0008 84/615
8,987,577 B2 * 3/2015 Eventoff ..... G10H 3/00 84/723
2005/0056139 A1 * 3/2005 Sakurada ..... G10H 5/005 84/616
2005/0076774 A1 * 4/2005 Sakurada ..... G10H 1/0016 84/616
2007/0017352 A1 * 1/2007 Masuda ..... G10H 1/053 84/658
2015/0101477 A1 * 4/2015 Park ..... G10H 7/002 84/633

* cited by examiner

ELECTRONIC MUSICAL INSTRUMENT, METHOD OF CONTROLLING SOUND GENERATION, AND COMPUTER READABLE RECORDING MEDIUM

CROSS-REFERENCE TO RELATED APPLICATION

The present application is based upon and claims the benefit of priority from the prior Japanese Patent Application No. 2014-110810, filed May 29, 2014, the entire contents of which are incorporated herein by reference.

BACKGROUND OF THE INVENTION

1. Field of the Invention

The present invention relates to a specific performance technique for an electronic musical instrument, and more particularly, to a technique of controlling generation of a tone to be generated by the specific performance technique for the electronic musical instrument.

2. Description of the Related Art

In an electronic musical instrument realizing a wind instrument (for instance, a saxophone) by using an electronic technique, a conventional technique is disclosed in Japanese Patent Publication No. 2605761, which technique allows a player to use player's blowing intensity and/or strength of biting a mouthpiece of the wind instrument as musical parameters and to give a blowing performance of the wind instrument in accordance with characteristic values of such musical parameters.

Further, another conventional technique employed in the electronic musical instrument is disclosed in Japanese Patent Publication Nos. 2712406 and 3389618, which technique detects a position and/or movement of the tongue of the player of the wind instrument (a tonging playing) to control a sound in generation of the wind instrument.

There are several playing techniques for the typical wind instruments, such as the simply blowing into the wind instrument, tonging playing, and a specific performance, that is, the player of the wind instrument utters a voice while he/she is blowing into the wind instrument, thereby generating growling tones.

The conventional technique in the electronic musical instrument does not allow the player to give the specific performance by uttering a voice while he/she is blowing into the wind instrument.

The present invention provides an electronic musical instrument which detects that the player has uttered a voice while he/she is blowing into the wind instrument, and generates tones specific to the wind instrument.

SUMMARY OF THE INVENTION

According to one aspect of the invention, there is provided an electronic musical instrument which comprises a voice sensor which detects a voice uttered by a user, when the user blows into the musical instrument with a voice, a breath sensor which detects at least one of a blow pressure and a blow volume in a body of the musical instrument, when the use blows into the musical instrument with a voice, and a musical tone controlling unit which controls generation of a musical tone based on at least one of outputs of the voice sensor and the breath sensor.

According to another aspect of the invention, there is provided a method of controlling generation of a tone, in an electronic musical instrument having a breath sensor and a voice sensor, the method which comprises a step of detecting a voice of a user by a voice sensor, when the user blows into the musical instrument with a voice, a step of detecting at least one of a blow pressure and a blow volume in a body of the musical instrument by a breath sensor, when the user blows into the musical instrument with a voice, and a step of controlling generation of a musical tone based on at least one of outputs of the voice sensor and the breath sensor.

DETAILED DESCRIPTION OF THE PREFERRED EMBODIMENTS

An electronic musical instrument (electronic wind instrument) according to the embodiments of the invention will be described with reference to the accompanying drawings in detail.

Figure 1:
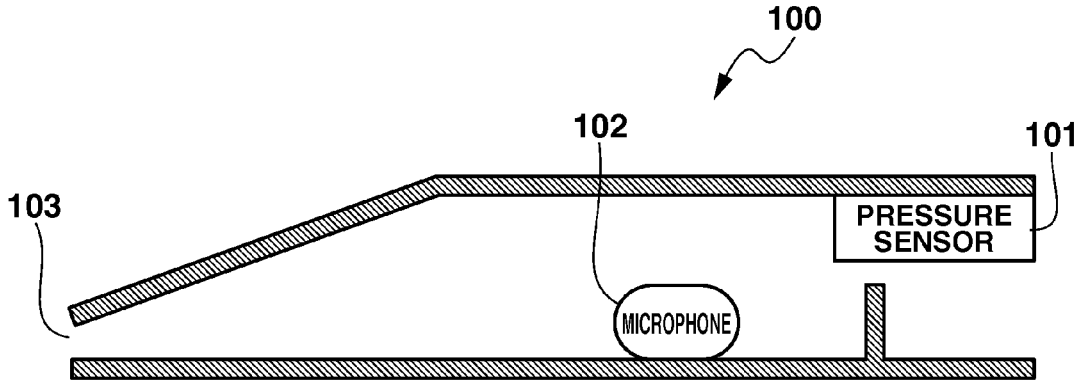
FIG. 1 is a across sectional view of a mouthpiece of an electronic musical instrument according to the embodiments of the invention.

FIG. 1 is a across sectional view of a mouthpiece 100 of the electronic wind instrument according to the embodiments of the invention.

The mouthpiece 100 of the electronic wind instrument is provided with a pressure sensor 101 in the depth part thereof. When a player of the electronic wind instrument blows into the blowing aperture 103 of the mouthpiece 100, the pressure sensor 101 detects a blow pressure and generates an analog signal representing the detected blow pressure.

Further, the mouthpiece 100 is provided with a microphone (voice sensor) 102. The voice sensor 102 detects a human voice uttered by the player while he/she is blowing into the wind instrument, and generates an analog signal representing the detected human voice.

Figure 2:
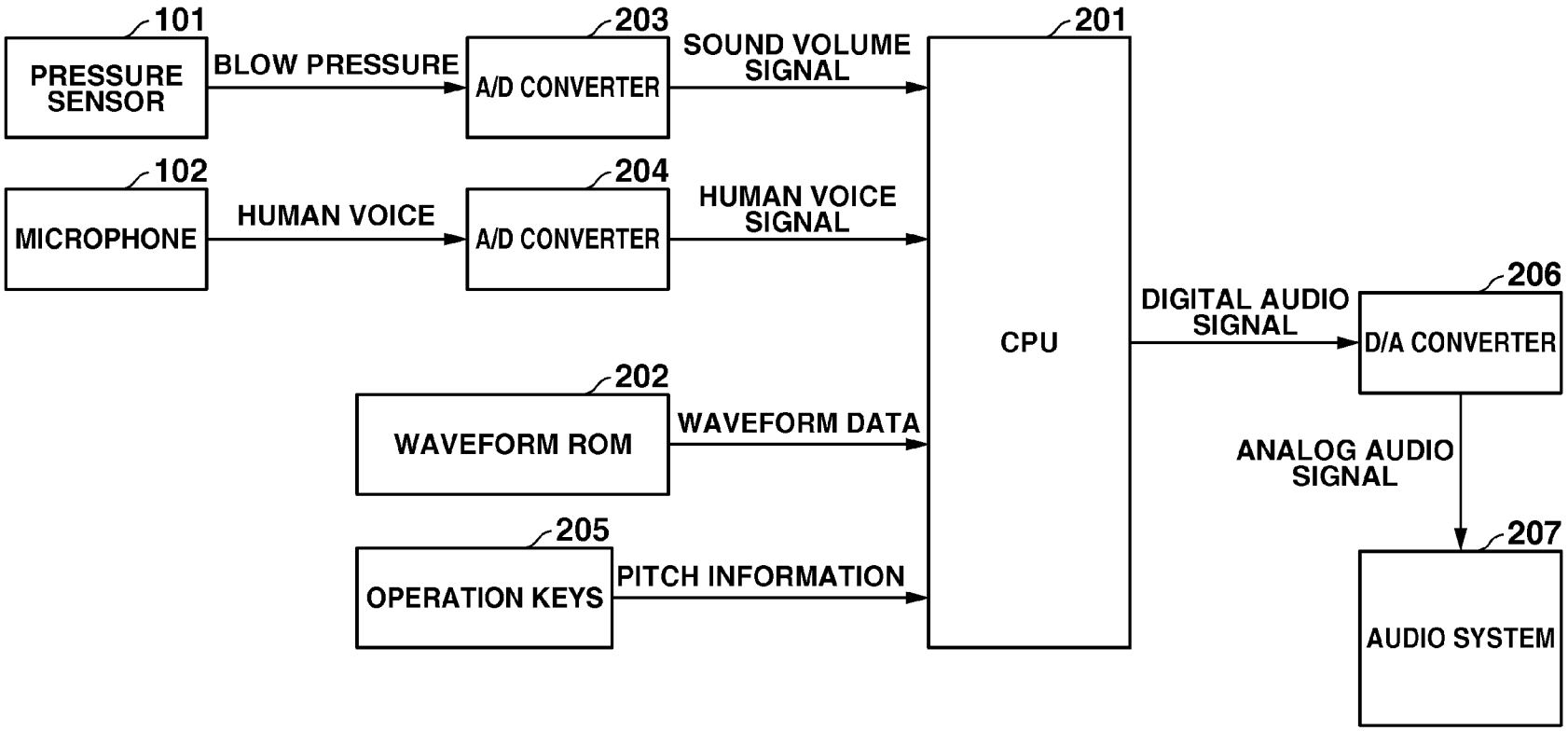
FIG. 2 is a block diagram of a circuit configuration of the electronic musical instrument according to the first embodiment of the invention.

FIG. 2 is a block diagram of a circuit configuration of the electronic wind instrument according to the first embodiment of the invention.

The analog signal generated by the pressure sensor 101 is sent to an Analog/Digital converter 203, wherein the analog signal is converted into a digital signal representing a sound volume (a digital sound volume signal). The digital sound volume signal is further sent to CPU (Central Processing Unit) 201 (musical-tone controlling unit).

Meanwhile, the analog signal generated by the microphone (voice sensor) 102 is sent to an Analog/Digital converter 204, wherein the analog signal is converted into a digital signal representing a human voice (a digital human voice signal). The digital human voice signal is further sent to CPU (Central Processing Unit) 201 (musical-tone controlling unit).

A waveform ROM (Read Only Memory) 202 stores various sorts of waveform data to be used to generate instrument tones.

When the player presses an operation key(s) 205 of the electronic wind instrument, key data corresponding to the pressed operation key(s) is generated as pitch information and sent to CPU 201. The pitch information is used as an element to determine a pitch of the instrument tone.

Upon receipt of the sound volume signal sent from the pressure sensor 101 through Analog/Digital converter 203, the human voice signal sent from the microphone (voice sensor) 102 through Analog/Digital converter 204, and the pitch information corresponding to the pressed operation key(s), CPU 201 reads waveform data from the waveform ROM 202 as musical-tone waveform information to generate digital voice data. The digital voice data is supplied to a Digital/Analog converter 206, wherein the digital voice data is converted into an analog audio signal. The analog audio signal is supplied to an audio system 207 and amplified to such a level to be heard by the players, and then outputted.

Figure 3:
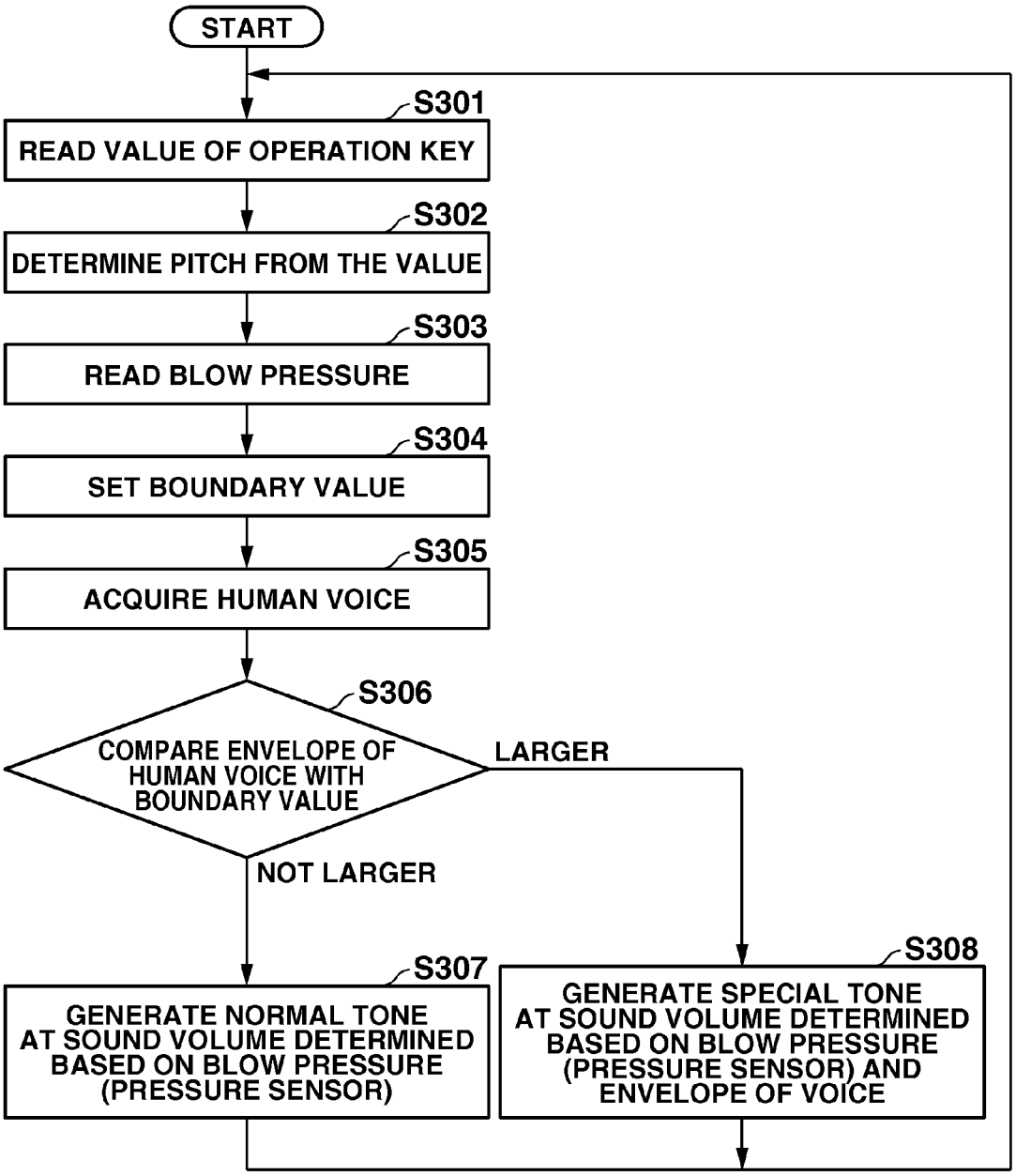
FIG. 3 is a flow chat of an example of a process of controlling generation of a sound performed in the first embodiment of the invention.

FIG. 3 is a flow chat of an example of a process of controlling generation of a tone performed in the first embodiment of the invention.

CPU 201 (in FIG. 2) runs a program for a tone-generation controlling process, stored in a built-in ROM (not shown) to perform the process of controlling generation of a tone, thereby realizing a function of a musical-tone controlling measure. The program for a tone-generation controlling process can be installed onto the built-in ROM or RAM (Random Access Memory) of CPU 201 from a variable recording medium mounted on a mobile recording medium driving apparatus (not shown) and/or from the Internet or a local area network through a network communication apparatus (not shown). Hereinafter, FIG. 1 and FIG. 2 will be referred to as needed.

CPU 201 reads a value of the pressed operation key 205 at first (step S301).

CPU 201 acquires the pitch information from the value of the pressed operation key 205 to determine a pitch of the instrument tone to be generated (step S302).

CPU 201 reads the blow pressure detected by the pressure sensor 101 to acquire the sound volume signal (step S303).

Then, CUP 201 sets a boundary value on the basis of the sound volume signal acquired from the pressure sensor 101 (step S304). For example, it is assumed that the boundary value is proportional to the sound volume signal acquired from the pressure sensor 101, and the boundary value can be set so as to increase as the acquired sound volume signal increases. Further, it is possible to allow a user to adjust the boundary value manually independently of the level of the sound volume signal.

CPU 201 acquires the human voice signal from the microphone (voice sensor) 102 (step S305).

CPU 201 rectifies the sound volume signal, thereby obtaining plural harmonic components. Then, CPU 201 compares the envelop(s) of one or plural harmonic component(s) with the boundary value set at step S304 (step S306).

When it is determined that the envelop(s) of one or plural harmonic component(s) is not larger than the boundary value, CPU 201 reads musical-tone waveform information of a normal tone from the waveform ROM 202 in accordance with the pitch determined at step S302 and a sound volume determined based on the sound volume signal acquired from the pressure sensor 101 at step S303, and outputs the musical-tone waveform information of a normal tone to D/A converter unit 206 (step S307). Thereafter, CPU 201 returns to step S301.

Meanwhile, when it is determined that the envelop(s) of one or plural harmonic component(s) is larger than the boundary value, CPU 201 reads musical-tone waveform information of a special tone or of a growling tone from the waveform. ROM 202 in accordance with the pitch determined at step S302 and a sound volume determined based on the sound volume signal acquired from the pressure sensor 101 at step S303 and the envelop(s), and outputs the musical-tone waveform information of a special tone to D/A converter unit 206 (step S308). Thereafter, CPU 201 returns to step S301.

Figure 4:
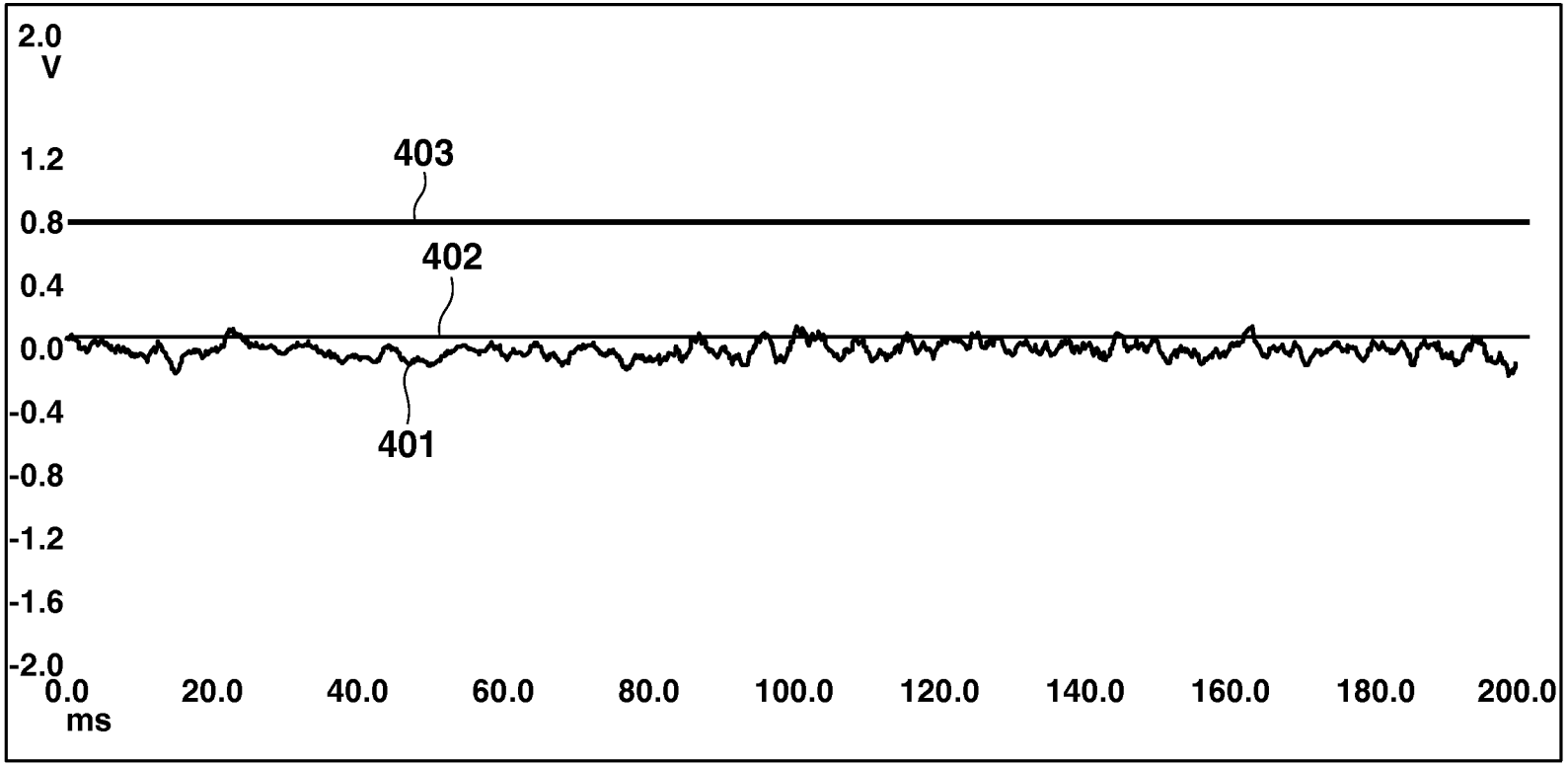
FIG. 4 is a view for explaining an operation of the electronic musical instrument according to the first embodiment of the invention.

FIG. 4 is a view (1) for explaining the operation of the first embodiment of the invention. In FIG. 4, the horizontal axis indicates a time [ms] and the vertical axis indicates a voltage or a level of the human voice signal 401 outputted from A/D converter 204 (in FIG. 2). A numeral 402 denotes an envelope of peak components of the human voice signal 401 acquired by CPU 201 at step S305 and step S306 (in FIG. 3). A numeral 403 denotes the boundary value which CPU 201 sets based on the sound volume signal acquired from the pressure sensor 101 at step S304 (in FIG. 3). When the player of the wind instrument utters no voice (that is, generates no growling tone) and the envelope 402 of the human voice signal 401 is smaller than the boundary value 403, as shown in FIG. 4, normal tones of the wind instrument are generated.

Figure 5:
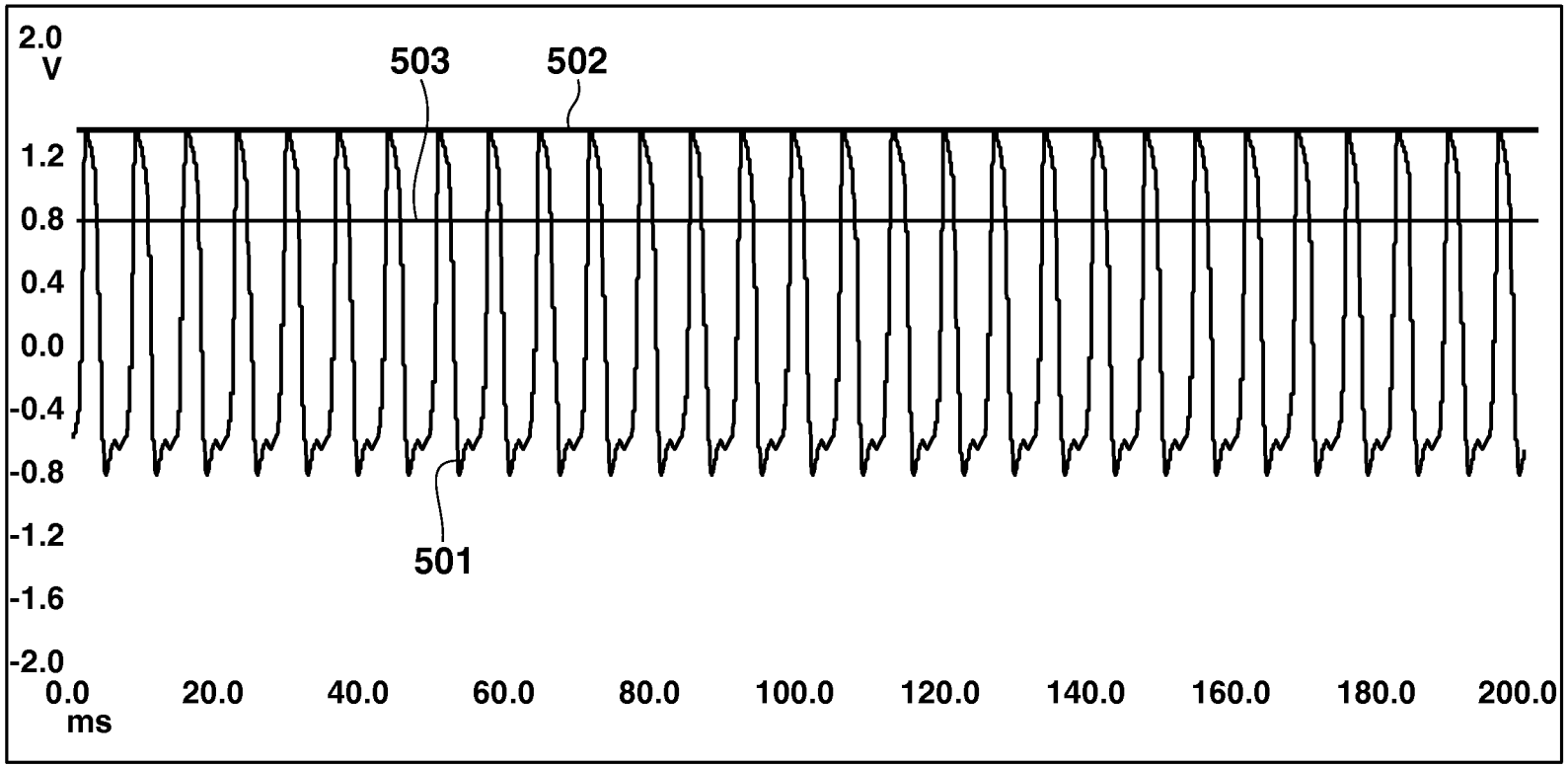
FIG. 5 is another view for explaining the operation of the electronic musical instrument according to the first embodiment of the invention.

FIG. 5 is a view (2) for explaining the operation of the first embodiment of the invention. Similarly in FIG. 5, the horizontal axis indicates a time [ms] and the vertical axis indicates a voltage or a level of the human voice signal 501 outputted from A/D converter 204 (in FIG. 2). A numeral 502 denotes an envelope of peak components of the human voice signal 501 acquired by CPU 201 at step S305 and step S306 (in FIG. 3). A numeral 503 denotes the boundary value which CPU 201 sets based on the sound volume signal acquired from the pressure sensor 101 at step S304 (in FIG. 3). When the player of the wind instrument utters voice (that is, generates growling tones) and the envelope 502 of the human voice signal 501 is larger than the boundary value 503, as shown in FIG. 5, growling tones of the wind instrument are generated.

Using the electronic instrument according to the first embodiment of the invention, the player can show a specific performance technique by uttering voice while he/she is blowing into the wind instrument (electronic instrument), thereby generating sampling growling tones specific to the wind instrument.

Figure 6:
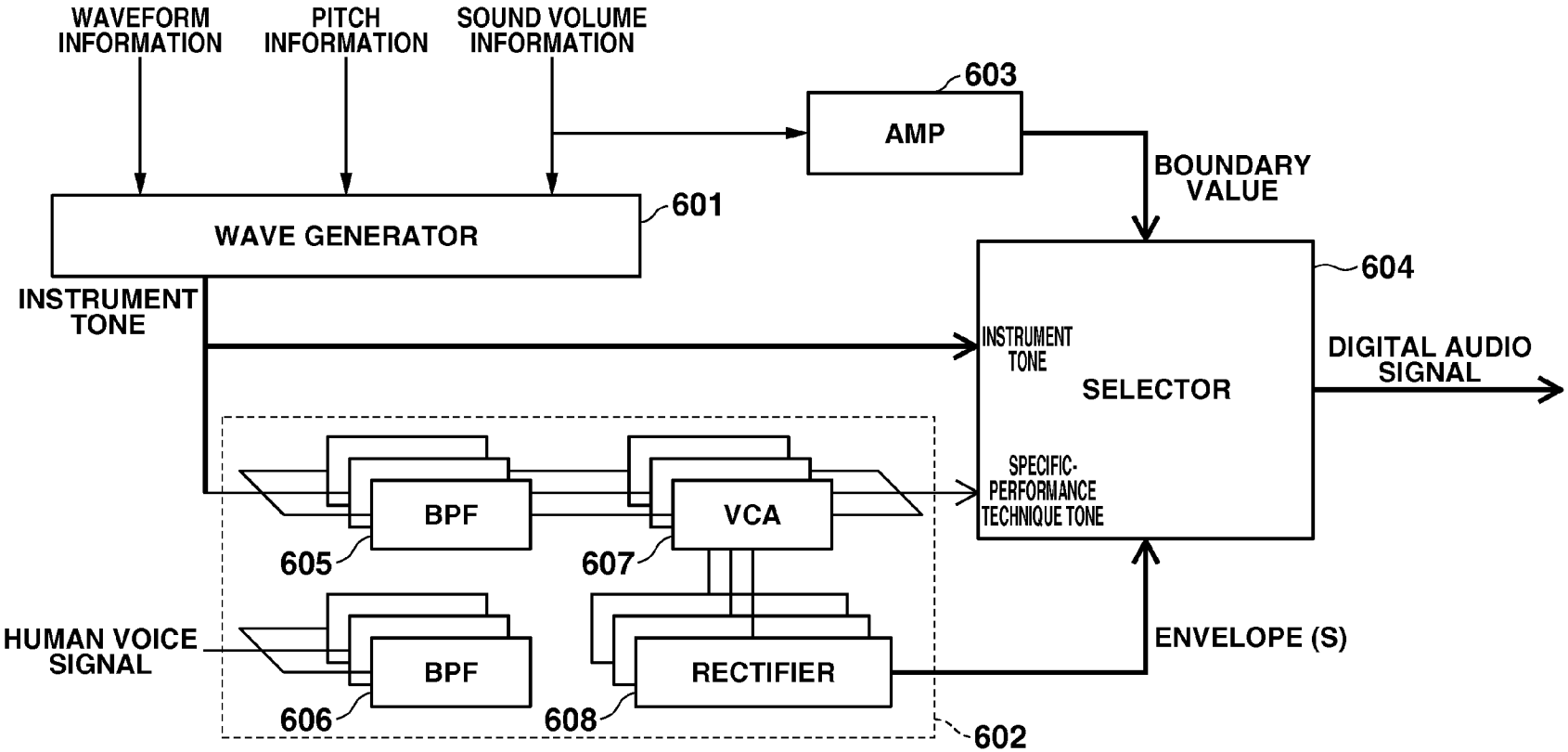
FIG. 6 is a block diagram of a circuit configuration of the electronic wind instrument according to the second embodiment of the invention.

FIG. 6 is a block diagram of a circuit configuration of the electronic wind instrument according to the second embodiment of the invention. The function of the circuit configuration shown in FIG. 6 is realized by CPU 201 running the program stored in the built-in ROM (not shown) in the first embodiment of the invention shown in FIG. 2. The circuit configuration shown in FIG. 6 is substantially the same as the circuit configuration in the first embodiment of the invention shown in FIG. 2 excepting CPU 201.

As shown in FIG. 6, Wave Generator (sound-generation block) 601 receives the musical-tone waveform information supplied from the waveform ROM 202 (FIG. 2), the pitch information supplied from the operation key(s) (FIG. 2), and the sound volume signal (sound volume information) sent from the pressure sensor 101 (FIG. 1 and FIG. 2), and produces an instrument tone based on the received information. In the present second embodiment of the invention, it is assumed to employ a "sampling" sound source using musical-tone waveform information supplied from the waveform ROM 202, but it is possible to construct the musical-tone waveform information by using other method such as a sine wave synthesis.

Tones based on the specific performance technique are produced by process circuit blocks surrounded by a broken line 602 in FIG. 6. The human voice signal outputted from A/D converter 204 (in FIG. 2) is supplied to plural band-pass filters (BPF) 606 and divided into plural signals. The divided signals are further supplied to rectifiers 608, respectively, whereby harmonic components of the human voice are obtained. The harmonic components of the human voice are data representing a characteristic of the voice.

Meanwhile, the instrument-tone signal generated from Wave Generator (sound-generation block) 601 is supplied to plural band-pass filters (BPF) 605 and divided into plural signals.

The divided signals are further supplied to plural VCA (Voltage Controlled Amplifiers) 607, wherein the divided signals are added with the harmonic components of the human voice outputted from the rectifiers 608, respectively.

The signals added with the harmonic components of the human voice outputted from VCA 607 are combined into one tone of the specific performance technique (specific-performance technique tone), and then, this specific-performance technique tone is sent to a selector 604. To other input terminal of the selector 604 is inputted the instrument-tone signal from Wave Generator (sound-generation block) 601. Meanwhile, the sound volume signal from A/D converter 203 is amplified by an amplifier 603 and supplied as the boundary value to a control input terminal of the selector 604.

When one of the envelopes or a sum of the plural envelopes outputted from the rectifiers 608 is not larger than the boundary value, the selector 604 outputs an instrument tone as a digital sound signal to D/A converter 206 (in FIG. 2). This process corresponds to the processes at step S306 and step S307 in the first embodiment of the invention.

When one of the envelopes or the sum of the plural envelopes outputted from the rectifiers 608 is larger than the boundary value, the selector 604 outputs a specific-performance technique tone as a digital sound signal to D/A converter 206 (in FIG. 2).

As described above, in the electronic wind instrument according to the second embodiment of the invention, when it is determined that the envelope is larger than the boundary value, it is assumed that the player has given the specific performance, and the selector 604 switches the instrument tone to the specific-performance technique tone. This boundary value is calculated based on and proportional to the blow pressure detected by the pressure sensor 101 (FIG. 2). Therefore, even if the player blows into the musical instrument while uttering a low voice, the boundary value becomes low accordingly, and the specific-performance technique tone can be outputted without failure.

As described above, in the electronic wind instrument according to the second embodiment of the invention, since it can be confirmed that the player blows into the instrument while uttering a low voice, the player can give the specific-performance to generate the tones specific to the wind instrument.

In the electronic instruments according to the first and second embodiments of the invention, the instrument tone to be outputted is switched from the normal instrument tone to the specific-performance technique tone based on whether the envelope of the human voice detected by the microphone (voice sensor) 102 is larger than the boundary value calculated based on the blow pressure detected by the pressure sensor 101 or not. Further, it is possible to combine and output the normal instrument tone with the specific-performance technique tone at a rate of the envelope to the boundary value.

In the case where the normal instrument tone is switched to the specific-performance technique tone depending on comparing the envelope with the boundary value, it is possible to use a hysteresis value in place of the fixed boundary value.

Further, in the electronic instruments according to the first and second embodiments of the invention, the blow pressure is detected by the pressure sensor 101, but a flow sensor can be used in place of the pressure sensor 101 to obtain a blow volume by the player.

Furthermore, it is possible for the musical instrument to employ a structure consisting of both the pressure sensor 101 and the flow sensor.

Although specific circuit configurations and structures of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. An electronic musical instrument comprising:

a voice sensor which detects a human voice uttered by a user, when the user blows into the musical instrument while uttering the voice;

a breath sensor which detects at least one of a blow pressure and a blow volume in a body of the musical instrument, when the user blows into the musical instrument while uttering the voice; and a processor which is configured to:

output data of a musical tone, based on at least one of an output of the voice sensor and an output of the breath sensor; and judge whether or not an envelope of the voice detected by the voice sensor has exceeded a boundary value, wherein:

the processor outputs, as the data of the musical tone, data of a first musical tone which is a normal tone of the electronic musical instrument not including voice data, when it is judged that the envelope of the voice has not exceeded the boundary value; and the processor outputs, as the data of the musical tone, data of a second musical tone which is a combination of (i) voice data and (ii) the normal tone of the electronic musical instrument not including the voice data, when it is judged that the envelope of the voice has exceeded the boundary value.

2. The electronic musical instrument according to claim 1, wherein the boundary value is set based on the output of the breath sensor.

3. The electronic musical instrument according to claim 1, wherein the processor is further configured to:

control a volume of the first musical tone based on an output of the breath sensor, when the data of the first musical tone is outputted, and control a volume of the second musical tone based on outputs of the breath sensor and the voice sensor, when the data of the second musical tone is output.

4. The electronic musical instrument according to claim 1, wherein the processor is further configured to:

mix, at a rate determined based on an envelope of the voice detected by the voice sensor, (i) the voice data and (ii) the normal tone of the electronic musical instrument not including the voice data, and output the mixed musical tone as the data of the second musical tone.

5. The electronic musical instrument according to claim 1, further comprising:

a waveform memory which stores musical-tone waveform data produced by sampling a tone generated in accordance with a specific-performance technique, and wherein the processor is further configured to read the musical-tone waveform data from the waveform memory and output the read data as the second musical tone, when it is judged that the envelope of the voice has exceeded the boundary value.

6. The electronic musical instrument according to claim 1, further comprising:

plural first band-pass filters which receive the first musical tone, allowing frequency components within different ranges to pass through, respectively; and plural second band-pass filters which receive an output of the voice sensor, allowing frequency components within different ranges to pass through, respectively, and wherein the processor is further configured to control plural outputs of the plural first band-pass filters based on plural outputs of the plural second band-pass filters, respectively, and to add the controlled outputs of the first band-pass filters together to be output as the second musical tone.

7. The electronic musical instrument according to claim 1, wherein the processor is further configured to control a volume of the musical tone based on the output of the breath sensor and the output of the voice sensor, when outputting the data of the musical tone.

8. The electronic musical instrument according to claim 1, wherein the data of the second musical tone comprises data of a growling tone.

9. A method of controlling generation of a tone, in an electronic musical instrument having a breath sensor and a voice sensor, the method comprising:

detecting a human voice uttered by a user by a voice sensor, when the user blows into the musical instrument while uttering the voice;

detecting at least one of a blow pressure and a blow volume in a body of the musical instrument by a breath sensor, when the user blows into the musical instrument while uttering the voice;

judging whether or not an envelope of the voice detected by the voice sensor has exceeded a boundary value; and outputting data of a musical tone based on at least one of an output of the voice sensor and an output of the breath sensor, wherein:

the outputting outputs, as the data of the musical tone, data which is a normal tone of the electronic musical instrument not including voice data, when the judging judges that the envelope of the voice has not exceeded the boundary value; and the outputting outputs, as the data of the musical tone, data which is a combination of (i) voice data and (ii) the normal tone of the electronic musical instrument not including the voice data, when the judging judges that the envelope of the voice has exceeded the boundary value.

10. A non-transitory computer-readable storage medium having an executable program stored thereon and being mounted on an electronic musical instrument having a breath sensor, a voice sensor, and a computer, wherein the program instructs the computer to perform processes comprising:

a voice detecting process of detecting a human voice of a user by a voice sensor, when the user blows into the musical instrument while uttering the voice;

a blow characteristic detecting process of detecting at least one of a blow pressure and a blow volume in a body of the musical instrument by a breath sensor, when the user blows into the musical instrument while uttering the voice;

a judging process of judging whether or not an envelope of the voice detected by the voice sensor has exceeded a boundary value; and a data output process of outputting data of a musical tone based on at least one of an output of the voice sensor and an output of the breath sensor, wherein:

the data output process outputs, as the data of the musical tone, data which is a normal tone of the electronic musical instrument not including voice data, when the judging process judges that the envelope of the voice has not exceeded the boundary value; and the data output process outputs, as the data of the musical tone, data which is a combination of (i) voice data and (ii) the normal tone of the electronic musical instrument not including the voice data, when the judging process judges that the envelope of the voice has exceeded the boundary value.

* * * * *